US010750840B2

(12) United States Patent
Lee et al.

(10) Patent No.: US 10,750,840 B2
(45) Date of Patent: Aug. 25, 2020

(54) TUBULAR CONTAINER HAVING APPLICATOR

(71) Applicants: YONWOO CO., LTD., Incheon (KR); HANKOOK COSMETICS MANUFACTURING CO., LTD, Seoul (KR)

(72) Inventors: Woong-Hee Lee, Incheon (KR); Sung-Taek Lim, Incheon (KR); Yeon-Jin Lee, Incheon (KR)

(73) Assignees: YONWOO CO., LTD., Incheon (KR); HANKOOK COSMETICS MANUFACTURING CO., LTD, Seoul (KR)

( * ) Notice: Subject to any disclaimer, the term of this patent is extended or adjusted under 35 U.S.C. 154(b) by 80 days.

(21) Appl. No.: 16/069,387

(22) PCT Filed: Dec. 5, 2017

(86) PCT No.: PCT/KR2017/014125
§ 371 (c)(1),
(2) Date: Jul. 11, 2018

(87) PCT Pub. No.: WO2018/174374
PCT Pub. Date: Sep. 27, 2018

(65) Prior Publication Data

US 2019/0335877 A1 Nov. 7, 2019

(30) Foreign Application Priority Data

Mar. 22, 2017 (KR) ..... 10-2017-0036309

(51) Int. Cl.
*B05C 11/00* (2006.01)
*A45D 34/04* (2006.01)
(Continued)

(52) U.S. Cl.
CPC ..... *A45D 34/04* (2013.01); *B65D 35/38* (2013.01); *B65D 35/44* (2013.01); *B65D 51/24* (2013.01); *A45D 2200/155* (2013.01)

(58) Field of Classification Search
CPC ..... A45D 34/04; B65D 35/38; B65D 35/04; B65D 35/44; B65D 51/24
(Continued)

(56) References Cited

U.S. PATENT DOCUMENTS 7,374,361 B1 * 5/2008 Kwon ..... A45D 34/04 401/202
7,883,287 B2 * 2/2011 Thorpe ..... A45D 34/04 401/266
(Continued)

FOREIGN PATENT DOCUMENTS

JP 2013-509231 A 3/2013
JP 5681707 B2 3/2015
(Continued)

OTHER PUBLICATIONS

Written Opinion issued in PCT Patent Application No. PCT/KR2017/014125 dated Mar. 30, 2018.
(Continued)

*Primary Examiner* — Jennifer C Chiang
(74) *Attorney, Agent, or Firm* — Marshall, Gerstein & Borun LLP

(57) ABSTRACT

A tubular vessel includes an applicator unit, configured to be used after separately storing an applicator unit, which is detachable, in the freezer, such that it is possible to maintain coldness when an application surface is attached on user's face, by storing refrigerant inside the applicator unit.

3 Claims, 6 Drawing Sheets

(51) Int. Cl.
*B65D 35/38* (2006.01)
*B65D 35/44* (2006.01)
*B65D 51/24* (2006.01)

(58) Field of Classification Search
USPC ..... 401/266
See application file for complete search history.

(56) References Cited

U.S. PATENT DOCUMENTS

| | | | | |
|---|---|---|---|---|
| 8,573,874 | B2 * | 11/2013 | Neuner | A45D 34/04 401/261 |
| 9,578,949 | B2 * | 2/2017 | Villarreal | A45D 34/04 |
| 9,681,728 | B2 * | 6/2017 | Jung | A45D 34/04 |
| 10,118,189 | B2 * | 11/2018 | Son | A45D 34/00 |
| 2008/0314405 | A1 * | 12/2008 | Chu | A45D 34/04 132/320 |
| 2014/0219701 | A1 * | 8/2014 | Eberlein | A45D 34/04 401/2 |

FOREIGN PATENT DOCUMENTS

| | | | |
|---|---|---|---|
| KR | 2007-0019291 | A | 2/2007 |
| KR | 2010-0117374 | A | 11/2010 |
| KR | 10-1103188 | B1 | 1/2012 |
| KR | 101533095 | B1 | 7/2015 |
| WO | WO-2015-052944 | A1 | 4/2015 |

OTHER PUBLICATIONS

International Search Report issued in PCT Patent Application No. PCT/KR2017/014125 dated Mar. 30, 2018.

Office Action issued in Korean Patent Application No. 10-2017-0036309 dated Aug. 17, 2017.

Office Action issued in Japanese Patent Application No. 2018-532277 dated May 21, 2019.

* cited by examiner

TUBULAR CONTAINER HAVING APPLICATOR

BACKGROUND OF THE INVENTION

The present invention disclosed herein relates to a tubular vessel with an applicator unit, a tubular vessel with an applicator unit, configured to be used after separately storing an applicator unit, which is detachable, in the freezer, such that it is possible to maintain coldness when an application surface is attached on user's face, by storing refrigerant inside the applicator unit.

Generally, a tubular container comprises a tube body receiving contents therein; a tube neck which is coupled to an upper portion of the tube body and supports the tube body, further comprising a discharging part to discharge content stored in the tube body; and an over cap which is detachably coupled to the tube neck and opens and closes the discharging part.

Tube containers as the above discharge contents through a discharging part when the tube body is pressurized, and as shown in FIG. 1 of the registered patent no. 10-1057333, have an applicator, like a brush which absorbs and discharges contents such that the contents can be applied easily, coupled to an upper portion structure (120).

In recent years, as the interest in skincare has increased, since it is hard to get enough amount of contents absorbed in the skin and contentable skincare effect by a simple absorption, there have been tried various methods to transfer warmth or coldness to the skin so as to promote the metabolism and improve elasticity of the skin. Hence, this type of cosmectic container is disclosed in the registered patent number 10-1131188 (hereafter called as 'the patent document 1").

The above patent document 1 is related to a dispenser, comprising a housing which is provided with a reservoir for storing contents; a heat storage tip which is coupled to the housing, composed of metal or ceramic, and provided with an application surface for applying contents onto skin surface; and an insert which is disposed inside the application surface of the heat storage tip and forms a contents moving passage. The contents moving passage extends through the heat storage tip and terminates inside an opening port of the application surface, and the insert is composed of thermoplastic polymer.

The above patent document 1 is configured to transfer warmth and coldness to user's skin when applying contents through a heat storage tip. However, since it is configured that the warmth and coldness is transferred through the heat storage tip simply made of metal, it is hard to maintain the continuency of the skin temperature when attaching the heat storage tip on user's skin. Therefore, there arises a problem of not providing the necessary function to promote the metabolism and improve elasticity of the skin.

SUMMARY OF THE INVENTION

The present invention disclosed herein relates to a tubular vessel with an applicator unit, a tubular vessel with an applicator unit, configured to be used after separately storing an applicator unit, which is detachable, in the freezer, such that it is possible to maintain coldness when an application surface of the applicator unit is attached on user's face, by storing refrigerant inside the applicator unit.

To solve the problems as in the above, a tubular container with an applicator unit according to the present invention includes a tube body storing contents; a tube neck which is coupled to an upper portion of the tube body and supports the tube body, and is provided with a nozzle which extends to an upper direction from the center portion of the tube body such that contents stored in the tube body can be discharged to the outside; an applicator unit which is detachably coupled to an inner side of the tube neck, further provided with an applicator surface which applies contents onto user's skin, a refrigerant storage part where refrigerant is stored for maintaining coldness of the applicator surface, and a discharge hole through which contents moving through the nozzle are discharged; a sealing cap coupled to as encasing a lower portion of the applicator unit and seals a lower end opened of the refrigerant storage part; and an over cap which is detachably coupled to the tube neck as encasing the applicator unit.

Furthermore, it is characterized in that at the center portion of the sealing cap is provided a insertion tube which extends to a direction directly below of the discharge hole such that the nozzle can be penetrated therethrough.

Furthermore, it is characterized in that at the center portion of the sealing cap is installed the nozzle and a sealing tube which is closely formed as encasing an outer circumferential surface of the insertion tube and prevents the refrigerant stored in the refrigerant storage part from being leaked.

Furthermore, it is characterized in that at an inner side of the tube neck is formed a reception groove which receives a lower portion of the applicator unit such that only an application surface of the applicator unit can be exposed to the outside.

Furthermore, it is characterized in that at an inner upper portion of the over cap is provided a an opening/closing rod which opens/closes the nozzle and the discharge hole.

As mentioned in the above, the present invention is configured to be used after separately storing an applicator unit, which is detachable, in the freezer, such that it is possible to maintain coldness when an application surface of the applicator unit is attached on user's face, by storing refrigerant inside the applicator unit.

DETAILED DESCRIPTION OF PREFERRED EMBODIMENTS

Figure 1:
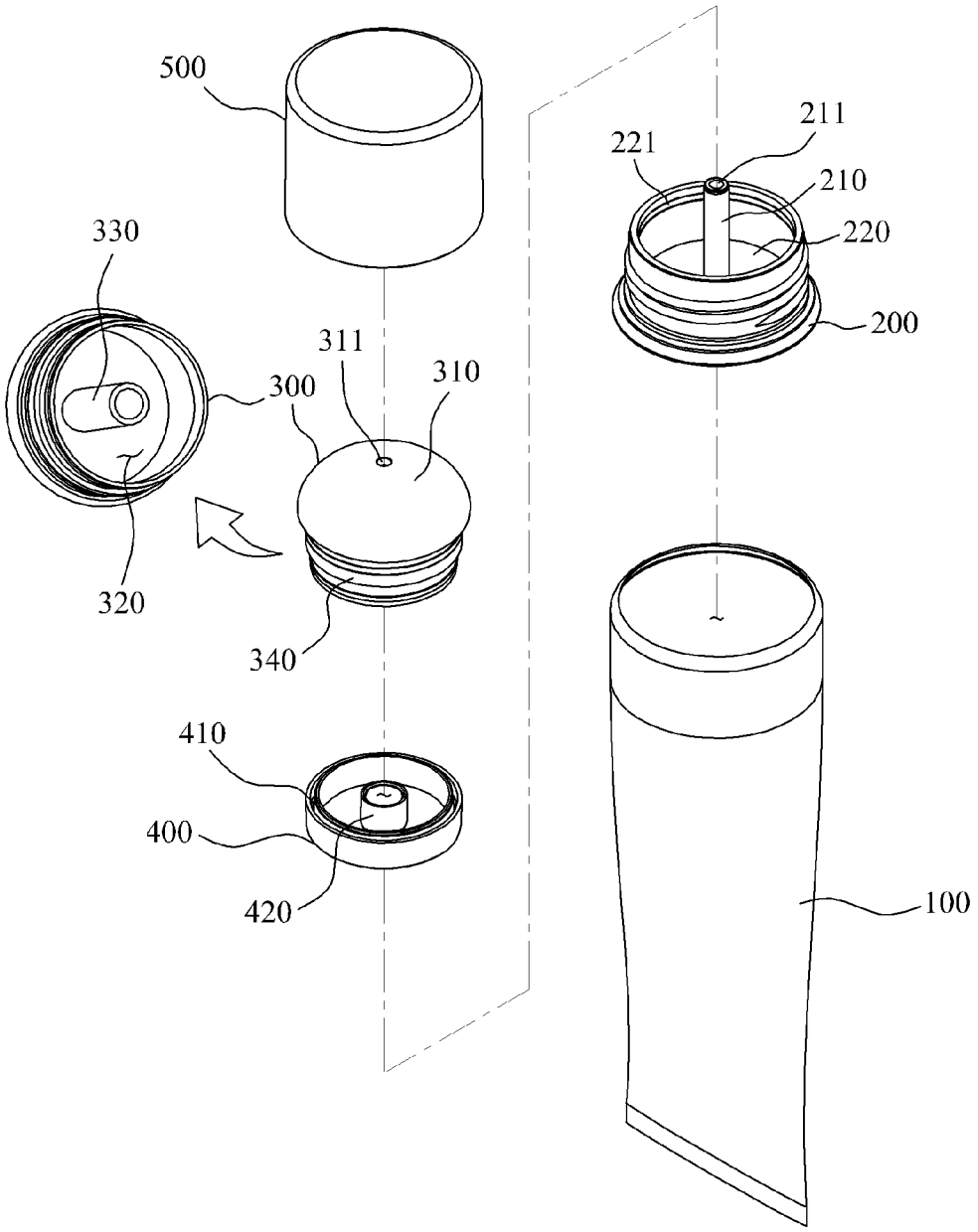
FIG. 1 is an exploded perspective view illustrating a configuration of a tubular container with an applicator unit according to an exemplary embodiment of the present invention.

Hereinafter, exemplary embodiments of the present invention will be described in detail with reference to the accompanying drawings. The same reference numerals provided in the drawings indicate the same members.

Figure 2:
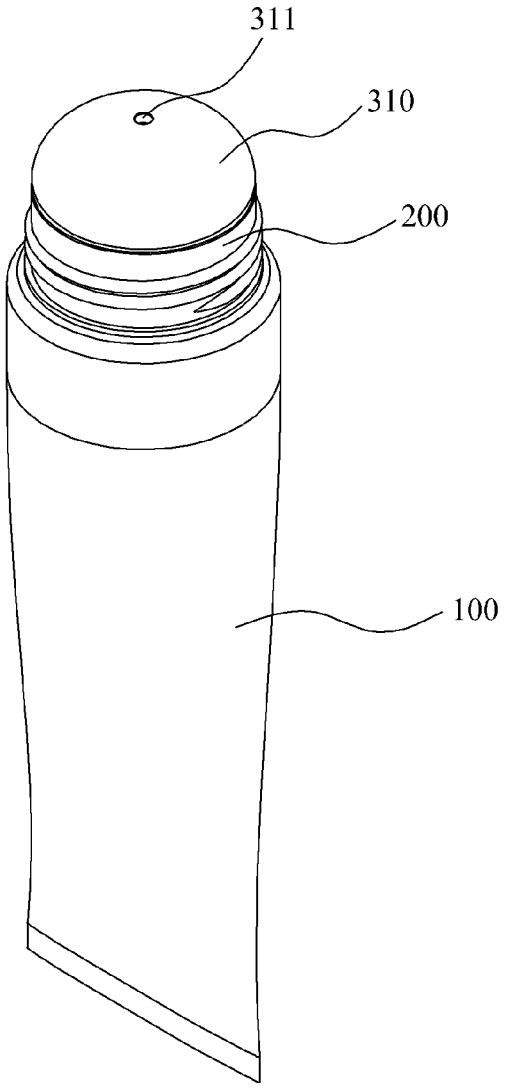
FIG. 2 is an assembled perspective view illustrating a configuration of a tubular container with an applicator unit according to an exemplary embodiment of the present invention.
Figure 3:
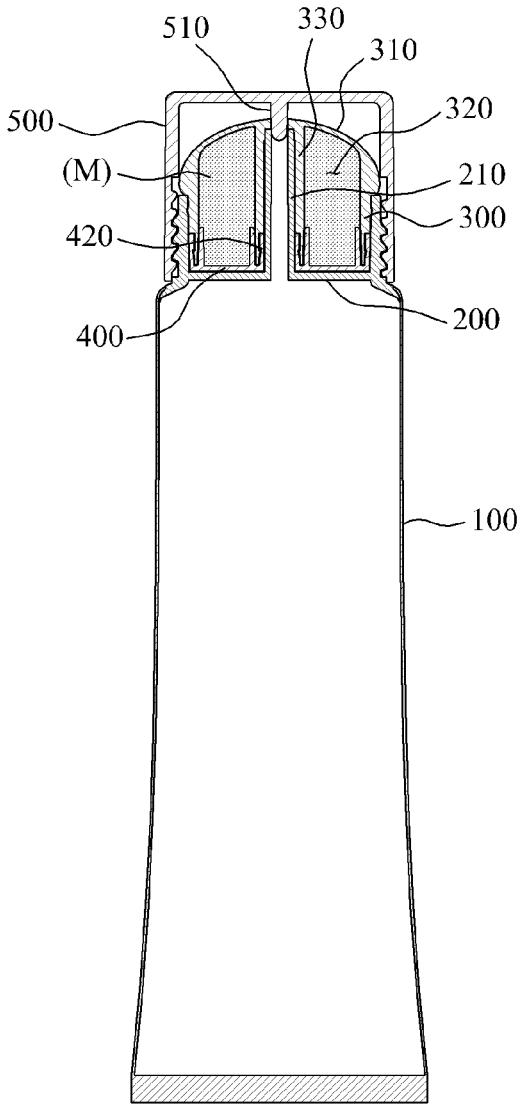
FIG. 3 is a assembled cross-sectional view illustrating a configuration of a tubular container with an applicator unit according to an exemplary embodiment of the present invention.

FIG. 1 is an exploded perspective view illustrating a configuration of a tubular container with an applicator unit according to an exemplary embodiment of the present invention. FIG. 2 is an assembled perspective view illustrating a configuration of a tubular container with an applicator unit according to an exemplary embodiment of the present invention. FIG. 3 is a assembled cross-sectional view illustrating a configuration of a tubular container with an applicator unit according to an exemplary embodiment of the present invention.

Referring to FIGS. 1 to 3, a tubular container with an applicator unit according to an exemplary embodiment of the present invention may include a tube body 100, a tube neck 200, an applicator unit 300, a sealing cap 400, and an over cap 500.

The tube body 100 receiving contents is deformed by user's pressurization and thus is made of a flexible tube material such as a tubal type blow container such that contents can be discharged by the internal pressure therein.

The tube neck 200, which is coupled to an upper portion of the tube body 100 and supports the tube body 100, is provided with a nozzle 210 which extends to an upper direction from the center portion thereof such that contents stored in the tube body 100 can be discharged therethrough.

In the present invention, it is characterized in that a reception groove 220 is formed at an inner side of the tube neck 200 for receiving an applicator unit 300, wherein a lower portion of the applicator unit 300 is received at the reception groove 220, such that only an application surface 310 of the applicator unit 300 can be exposed to the outside. Due to this, it is possible to maintain a stable coupling state of the applicator unit 300 and to minimize the area of the applicator unit 300 exposed to the external temperature such that the duration of the refrigerant (M) stored in the refrigerant storage part 320 is prolonged.

Meanwhile, at an inner circumferential surface of the tube neck 200 is formed a coupling groove 221 which is coupled with a coupling protrusion 340 of the applicator unit 300.

The applicator unit 300, which is coupled to an inner side of the tube neck 200 and applies contents onto user's skin, is provided with an application surface 310 formed with a discharge hole 311 such that contents moving through the nozzle hole 211 formed at an upper end of the nozzle 210. The application surface 310 is possible to have a variety of shapes such as a circle or a sphere depending on the area for make up.

In the present invention, the applicator unit 300 is characterized to be detachably coupled to the tube neck 200, wherein an applicator unit 300 is separated from a reception groove 220 and stored frozen in the freezer and then coupled to the tube neck 200 to be used, such that, when contents are applied onto the face, it is possible to transmit the coldness of the application surface 310 to the skin, thereby promoting the metabolism and improving the elasticity of the skin.

The applicator unit 300 is preferably configured to be made of a plastic material because there is a risk of frostbite due to can extremely low temperature thereof when the applicator unit 300 which was kept frozen is attached on the skin.

Meanwhile, it is characterized that at an inner side of the applicator unit 300 is provided a refrigerant storage part 320 where a refrigerant (M) is stored. Therefore, it is possible to efficiently maintain its coldness for a predetermined time, when a user attaches the application surface 310 of the applicator unit 300, by means of the refrigerant stored in the refrigerant storage part 320.

Meanwhile, at the center portion of the applicator unit 300 is provided an insertion tube 330 which extends to a direction directly below the discharge hole 311 such that the nozzle 210 can be installed to penetrate therethrough.

Furthermore, at an outer circumferential surface of the applicator unit 300 is provided a coupling protrusion 340 which is coupled to a coupling groove 221 of the reception groove 220.

The sealing cap 400, which is coupled as encasing a lower portion of the applicator unit 300 and seals an opened lower end of the refrigerant storage part 320, is provided with a sealing groove 410 for supporting, at both sides, an inner and an outer circumferential surfaces of a lower portion of the applicator unit 300.

The present invention is characterized in that the nozzle 210 is penetrated at the center portion of the sealing cap 400, and a sealing tube 420 is provided for preventing refrigerant (M) stored in the refrigerant storage part 320 from being leaked, wherein the sealing tube 420 encases an outer circumferential surface of the insertion tube 330 as being closely contacted thereto and thereby prevents the refrigerant (M) stored in the refrigerant storage part 320 from being leaked through a space between an inner circumferential surface of the refrigerant storage part 320 and the inner circumferential surface of the sealing tube 420.

The over cap 500, which is detachably coupled to the tube neck 200 as encasing the applicator unit 300, is provided with an opening/closing rod 510 which protrudes to a downward direction at an upper inner side thereof so as to open/close the discharge hole 311 and the nozzle hole 211.

Figure 4:
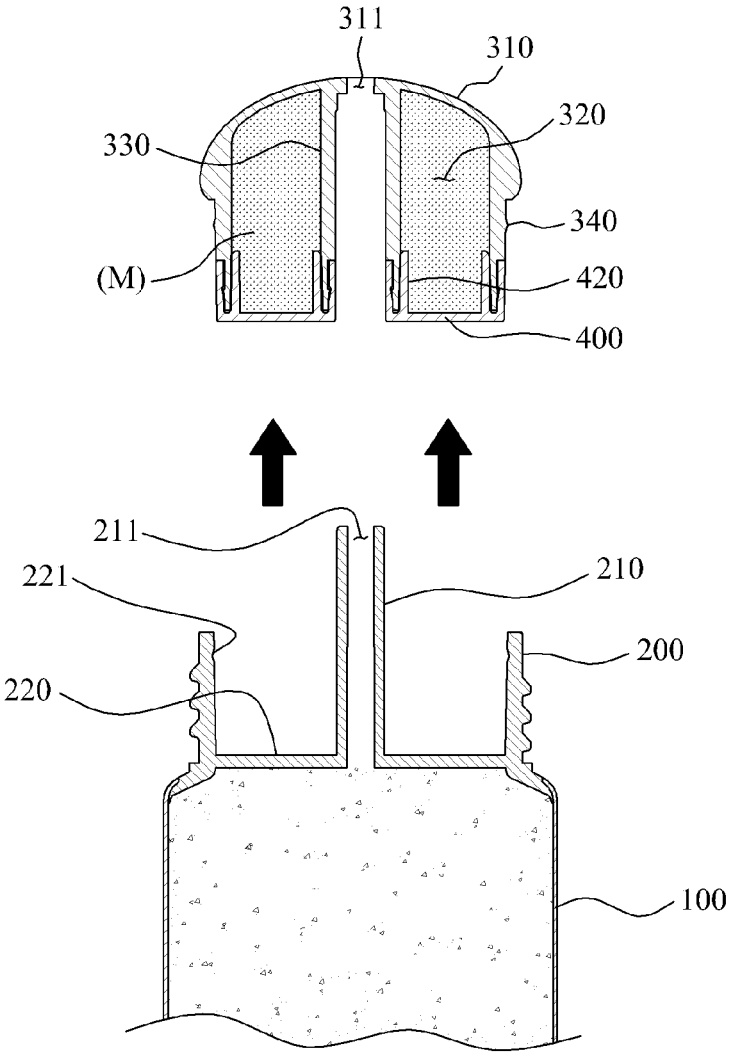
FIGS. 4 to 6 are explanatory drawings illustrating a usage method intents of a tubular container with an applicator unit according to an exemplary embodiment of the present invention.
Figure 5:
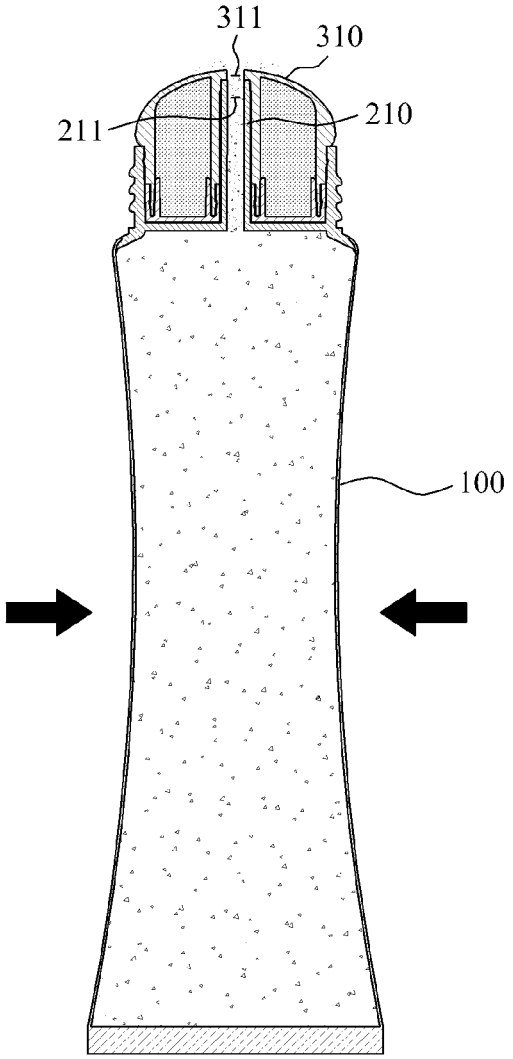
Figure 6:
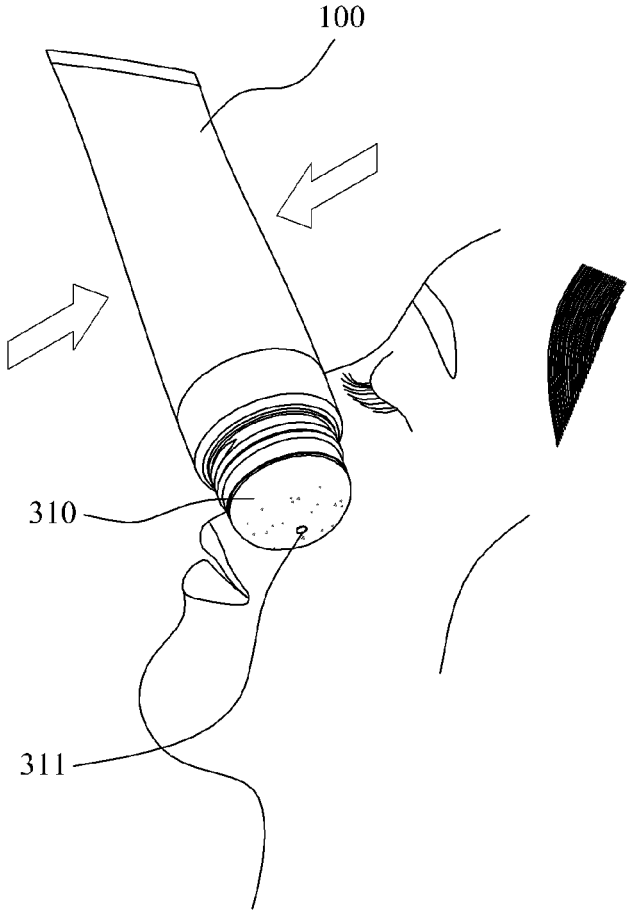

Hereinafter, referring FIGS. 4 to 6, a usage method of a tubular container with an applicator unit according to an exemplary embodiment of the present invention will be described.

First, after the applicator unit 300 is separated from the tube neck 200, the applicator unit 300 is kept in the freezer to be frozen. Then, when the frozen applicator unit 300 is coupled to the tube neck 200 and the tube body 100 is pressurized, the contents stored in the tube body 100 are discharged to the application surface 310 through the discharge hole 311 via the nozzle 210. At this moment, it is possible to attach the application surface 310 on user's skin and apply contents discharged onto the application surface 310 to the user's skin.

As in the above, since the coldness of the application surface 310 can be maintained for the predetermined time by means of the refrigerant (M) stored in the refrigerant storage part 320 when applying contents on user's skin by means of the application surface 310, it is possible to efficiently continue skin care procedure.

The present invention, as previously described in the above, is characterized to be provided with a application surface 310 and a refrigerant storage part 320 at an applicator unit 300, such that it is possible to maintain coldness of the application surface 310 by means of the refrigerant (M) stored in the refrigerant storage part 320 along with the function of applying contents by means of the application surface 310.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Therefore, the scope of the present invention should be defined by the technical spirit of the accompanying claims.

What is claimed is:

1. A tubular container with an applicator unit comprising:

a tube body storing contents;

a tube neck coupled to an upper portion of the tube body and supporting the tube body, and provided with a nozzle extending to an upper direction from the center portion of the tube body such that contents stored in the tube body can be discharged to the outside;

an applicator unit detachably coupled to an inner side of the tube neck, further provided with an application surface which applies contents onto user's skin, a refrigerant storage part where refrigerant is stored for maintaining coldness of the application surface, and a discharge hole through which contents moving through the nozzle are discharged;

a sealing cap coupled to as encasing a lower portion of the applicator unit and sealing a lower end opened of the refrigerant storage part; and an over cap detachably coupled to the tube neck as encasing the applicator unit, wherein at an inner side of the tube neck is formed a reception groove receiving a lower portion of the applicator unit such that only an application surface of the applicator unit can be exposed to the outside, and wherein at the center portion of the sealing cap is provided an insertion tube that extends to a direction directly below the discharge hole such that the nozzle can be penetrated therethrough.

2. The tubular container with an applicator unit of claim 1, wherein at the center portion of the sealing cap is installed a sealing tube which is closely formed as encasing an outer circumferential surface of the insertion tube and prevents the refrigerant stored in the refrigerant storage part from being leaked.

3. The tubular container with an applicator unit of claim 1, wherein at an inner upper portion of the over cap is provided a an opening/closing rod which opens/closes the nozzle and the discharge hole.

* * * * *